United States Patent [19]

Vergel, Jr.

[11] Patent Number: 4,683,724

[45] Date of Patent: Aug. 4, 1987

[54] REFRIGERATION MOISTURE ELIMINATING DEVICE AND METHOD

[75] Inventor: Jorge Vergel, Jr., Belle Glade, Fla.

[73] Assignee: V. M. International, Inc., Belle Glade, Fla.

[21] Appl. No.: 792,219

[22] Filed: Oct. 28, 1985

[51] Int. Cl.[4] ..... F25B 47/00

[52] U.S. Cl. ..... 62/85; 62/127; 62/149; 62/475

[58] Field of Search ..... 62/85, 77, 88, 149, 62/292, 475, 125, 127, 93

[56] References Cited

U.S. PATENT DOCUMENTS

| | | | |
|---|---|---|---|
| 3,357,197 | 12/1967 | Massengale | 62/475 X |
| 4,110,998 | 9/1978 | Owen | 62/292 X |
| 4,304,102 | 12/1981 | Gray | 62/475 X |

*Primary Examiner*—Lloyd L. King

*Attorney, Agent, or Firm*—Harry W. Barron

[57] ABSTRACT

Described herein is apparatus and a method for eliminating water trapped in a refrigerator system. The apparatus includes means to insert heated, dry gas, such as nitrogen, into the low side valve of the refrigeration system. The gas may be to a temperature between 175 and 220 degrees F. and is inserted until the pressure of the gas within the system is equal to between 35 and 65 PSI. The device includes appropriate temperature and pressure metering means for controlling both the temperature and pressure of the gas inserted. After the heated nitrogen gas is inserted into the refrigeration system, the compressor is turned on and allowed to run for approximately ten minutes and the heated nitrogen gas absorbs any water vapor in the refrigeration system. Thereafter the high side valve is opened and the escaping nitrogen containing the absorbed water escapes from the system. Then the refrigerant is added and when it begins escaping from the open high side valve, the high side valve is closed. In alternate embodiment, a gas feedback path from the high side valve to the input side of the apparatus is provided to speed the heating of the gas.

27 Claims, 4 Drawing Figures

REFRIGERATION MOISTURE ELIMINATING DEVICE AND METHOD

This invention relates to a device and method for eliminating moisture which has built up in a refrigeration system and more particularly to such a device and method for inserting a heated dry gas under pressure into the refrigeration system, operating such system, and thereafter removing such gas.

As is well known in the art, a refrigeration system consists primarily of four components. These are the compressor, condenser, metering device and evaporator. In operation, the conventional refrigerator condenser condenses a refrigerant, such as Freon or other types of fluorocarbons, and provides the compressed gas to the condenser. The condenser condenses the refrigerant material and provides it through the capillary tubes to the evaporator where the condensed refrigerant is evaporated thereby absorbing heat to thereby allow the cooling effect to occur. From the evaporator, the evaporated refrigerant is provided back to the compressor where the cycle is continuously repeated. Positioned between the compressor and the evaporator is a low pressure side valve or a process tube on the compressor and positioned between the condenser and the metering device is a high pressure side valve. Either of the two valves can be opened in order to allow gas to be added to the refrigeration system or purged from the refrigeration system. In addition to the above components, it is common practice to include a strainer or dryer filter within the system typically positioned between the high side valve and the metering device.

As is well known, any refrigeration system is susceptible to leaks through which moist air or other contaminants can enter into the system. Any moisture which may enter the system through such leaks can seriously affect the performance of the refrigeration unit. After the leak or any other repairs in the sealed system of the refrigeration unit has been repaired, it is desirable to eliminate as much of the moisture from the unit as possible. This typically has been done in the past by connecting a vacuum pump to the low and high side valve and evacuating as much of the gas from the refrigeration unit as possible. While this procedure has proven effective in the past, it generally requires several hours to accomplish the result.

It would be preferable to have a simple device which could insert a gaseous material into the refrigeration system which would automatically remove any of the contaminants such as moisture. Such material should be inert with respect to the refrigerant material so that any residue thereof will have no affect on the refrigeration process.

In accordance with one aspect of this invention, there is provided apparatus for removing moisture from a refrigeration unit which unit includes a condenser, compressor and an evaporator coupled in a loop and further includes a low pressure side valve between the compressor and the evaporator and the high pressure side valve between the condenser and the evaporator. The apparatus for removing moisture comprises output coupling means adapted for being coupled to the low pressure side valve and input coupling means adapted for being coupled to source of dry gas. In addition, the apparatus for removing moisture has gas transfer and heating means positioned between the output coupling means and the input coupling means for transferring and heating the dry gas applied to the input coupling means to the output coupling means and sensing means for sensing the temperature and pressure of the dry gas transferred to said output coupling means. Lastly, the apparatus includes means for manifesting the sensed temperature and pressure to indicate when to close the low pressure side valve.

In accordance with another aspect of this invention, there is provided a method of removing moisture from a refrigeration unit which unit includes a compressor, a condenser and an evaporator connected in a loop. The refrigeration unit further has a low pressure side valve positioned between the evaporator and the compressor and a high pressure side valve positioned between the condenser and the evaporator. The method comprises the steps of heating a dry gas, providing said heated dry gas through said low pressure side valve, operating said refrigeration unit, opening said high pressure side valve and providing refrigerant through said low pressure side valve.

One preferred embodiment of the present invention is hereafter described with specific reference being made to the following Figures, in which.

Figure 1:
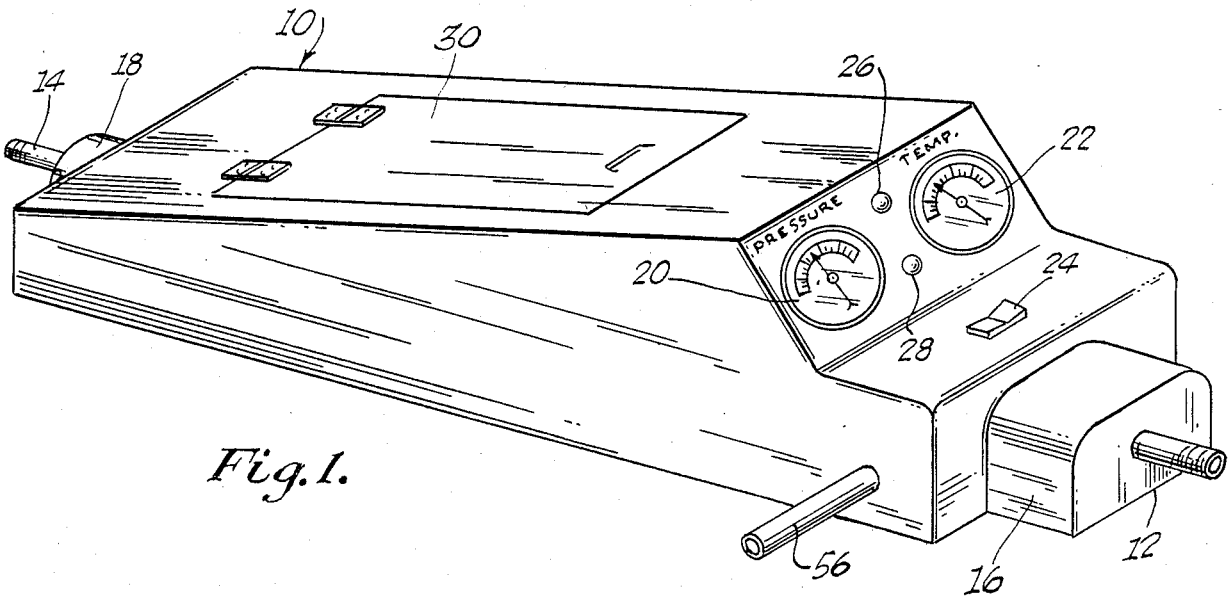
FIG. 1 shows the gas heating and insertion device used for moisture elimination of the subject invention.

Referring now to FIG. 1, the gas heating and insertion device 10 is shown and includes an input pipe 12 and an output pipe 14. Input pipe 12 is adapted to being coupled to a tank of a dry gas. The gas should be of a type which does not affect the performance of the refrigerant and may be, for example, nitrogen, helium or air. The gas is provided through pipe 12 into a regulator 16 which allows the gas to pass therethrough so long as the pressure beyond regulator 16 is less than a certain value. For example, regulator 16 may be of the type that opens at 45 pounds per square inch (psi) and closes at 65 psi. Output pipe 14 is adapted to being coupled to the low side valve or process tube in a refrigeration system and heated gas from within device 10 is provided through a safety relief valve 18 into pipe 14. Safety valve 18 may be set at a maximum of 120 psi so that if the pressure within device 10 ever exceeds that amount, safety valve 18 automatically opens and allows gas to escape.

In addition, gas heating and insertion device 10 includes a temperature gauge 20, and a pressure gauge 22 for reading the temperature and pressure of the gas in device 10 between input pipe 12 and output pipe 14. Further, device 10 includes an on/off switch 24 and associated on/off light 26. Further, a ready light 28 is provided to indicate to the operator that the proper temperature of the inside of cylinder pipe 46 has been attained. Lastly, device 10 includes a storage door 30 which can be opened to allow associate piping and fitting to be stored. Such pipe may be used to couple pipe 12 to the source of gas or pipe 14 to the low side valve in the refrigeration system.

Figure 2:
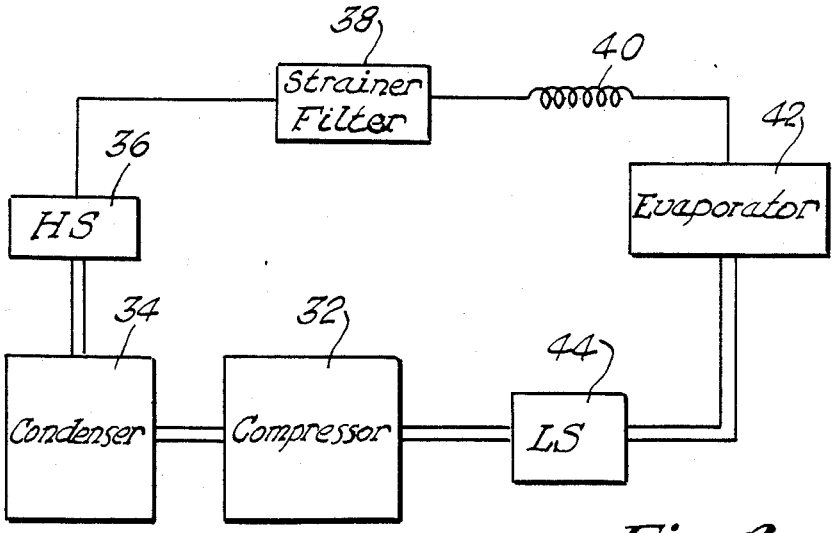
FIG. 2 shows a block diagram of a typical refrigeration unit.

Referring now to FIG. 2, a typical refrigeration system is shown in block diagram. Refrigeration system includes a compressor 32, condenser 34, high pressure side valve 36, strainer filter 38, capillary tubing 40, evaporator 42 and low pressure side valve 44. Both the high pressure side valve 36 and the low pressure side valve 44 are accessible to a person desiring to work with the refrigeration unit. For example, low pressure side valve 44 may be opened to allow gas or refrigerant to be placed into the system and high pressure side valve 36 may be opened to allow gas already in the system to be expelled therefrom.

Figure 3:
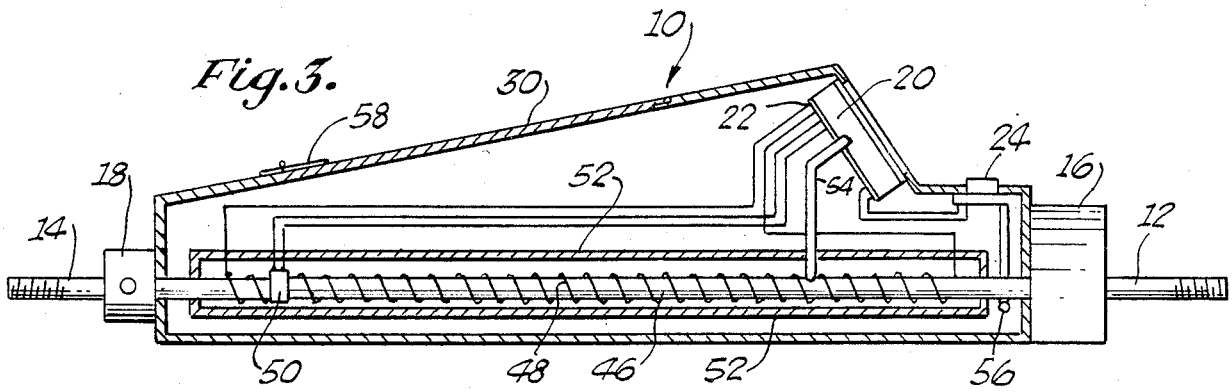
FIG. 3 shows a cut away view of the device shown in FIG. 1.

Referring now to FIG. 3, the internal construction of gas heating and insertion device 10 is shown. Between regulator 16 and safety valve 18 is a heater pipe 46 on which is wound a heating coil 48. Heating coil 48 may be a conventional strip heater or other mechanism adapted to heat pipe 46. After setting switch 24 to the ON position, and waiting for light 28 to become illuminated, thereby indicting the temperature of pipe 46 is at 220 degrees, the valve on the gas tank is opened and gas flows into pipe 46. The temperature controlling light 28 can be measured by a thermostat 50 coupled towards the safety valve side of pipe 46. Wires leading from thermostat 50 may be coupled to temperature gauge 22 along with wires from the ends of heating coil 48. When thermostat 50 senses that the temperature is above 220 degrees F., it engages a switch disconnecting current from heating coil 48 and when thermostat 50 senses that the temperature has fallen below for instance 175 degrees F. it may close the switch allowing further current to be applied to coil 48. In addition, the wires from thermostat 50 allow the temperature to be displayed on gauge 22 and light 28 to be illuminated when the sensed temperature is between 175 degrees and 220 derees.

Surrounding heating pipe 46 and heating coil 48 is an insulation case 52 which is designed to maintain the heat generated by coil 48 within the confines of pipe 46. Extending through insulation case 52 is a pipe 54 from pressure gauge 20. Pressure gauge 20 measures the pressure internal to pipe 46. When pipe 4 is coupled to the low pressure side valve 44 of the refrigeration unit shown in FIG. 2, the pressure within pipe 48 is equal to the pressure within the refrigertion system shown in FIG. 2. This pressure should be no greater than the maximum permitted by regulator 16, which may be between 35 and 65 psi depending upon the specifications of the unit. Generally, however the pressure should remain below 45 psi. square inch.

Power to device 10 is obtained from power cord 56 which may be inserted into any conventional 110 volt socket. The power cord 56 is applied through switch 24 and when switch 24 is in the closed position power is applied to heater coil 48 in conjunction with the operation of thermostate 50 as previously described. In addition, wires (not shown) may be coupled from switch 24 to on/off light 26 to manifest to the operator whether switch 24 is in the on or the off position. In addition, wires (not shown) may be coupled from temperature gauges 22 to ready light 28 to indicate when proper temperature has been sensed within pipe 46.

As can be seen best in FIG. 3, any additional pipe required to connect either pipe 12 or pipe 14 to the respective gas tank or low side valve may be stored within device 10. Door 30 may be opened around hinges 58 and the pipes inserted therein. It should be noted that the wires shown in FIG. 3 connecting coil 48 and thermostat 50 may be placed along the side panels of the package of device 10 so that the pipes may be stored conveniently at any place above insulation case 52.

The method of using the gas heating and insertion device 10 to eliminate water from refrigeration system shown in FIG. 2 will now be described. First, output pipe 14 is coupled to low pressure side valve 44 in FIG. 2 and input pipe 12 is coupled to a tank of dry gas, such as nitrogen connect. High side value −36 to inlet 70 to heating device. The gas is allowed to enter through input pipe 12 and regulator 16 into heater pipe 46 and power is applied to heater coil 48 to heat the gas within pipe 46. The time that heater coil 48 is on is determined by thermostat 50 which measures the temperature of the gas internal to pipe 46. The heated gas is applied out through safety valve 18 and output pipe 14 and into the open low side valve 44. Low side valve 44 may be adjusted so that the flow of the gas therein is sufficient to allow the gas to be fully heated to between 175 and 220 degrees F., while being moved through pipe 48. The insertion of the heated gas continues until the pressure of the gas in the refrigeration system shown in FIG. 2 as well as the pressure within pipe 46 is between 35 and 65 PSI. At this point in time, regulator 16 is closed completely and heating device is not disconnected.

At this point in time the refrigeration system shown in FIG. 2 is rendered operative by turning on compressor 32. Compressor 32 is allowed to run for approximately ten minutes so that the heated nitrogen gas inserted therein, is moved throughout the entire refrigeration system. As the gas is compressed by the compressor and recirculated through the device, it further increases in temperature. After approximately ten minutes, any water within the refrigeration system will have been heated and turned to vapor by the hot nitrogen gas circulating in the refrigeration system. Then, the high pressure side valve 36 is opened and the nitrogen and water vapor is allowed to escape from the system. Thereafter, the refrigerant, such as freon, may be added to low side valve 44, further displacing and forcing out the nitrogen and water vapor. When the refrigerant begins to escape from high side valve 36, high side valve 36 is closed.

Using gas heating and insertion device 10 in the manner described, the water vapor left in the refrigeration system can be quickly and more efficiently removed than the evacuation techniques of the prior art. While one preferred embodiment of the invention has been described, many other variations and extentions are possible. For instance, automatic valves may be added that open only when the temperature of the gas is a certain amount. In addition, a two input valve may replace output pipe 14 so that the refrigerant may be added without disconnecting device 10. Further, electronic circuits may be added to operate in response to the sensed temperature and pressure to better control the application of the heated gas into the refrigeration system.

Figure 4:
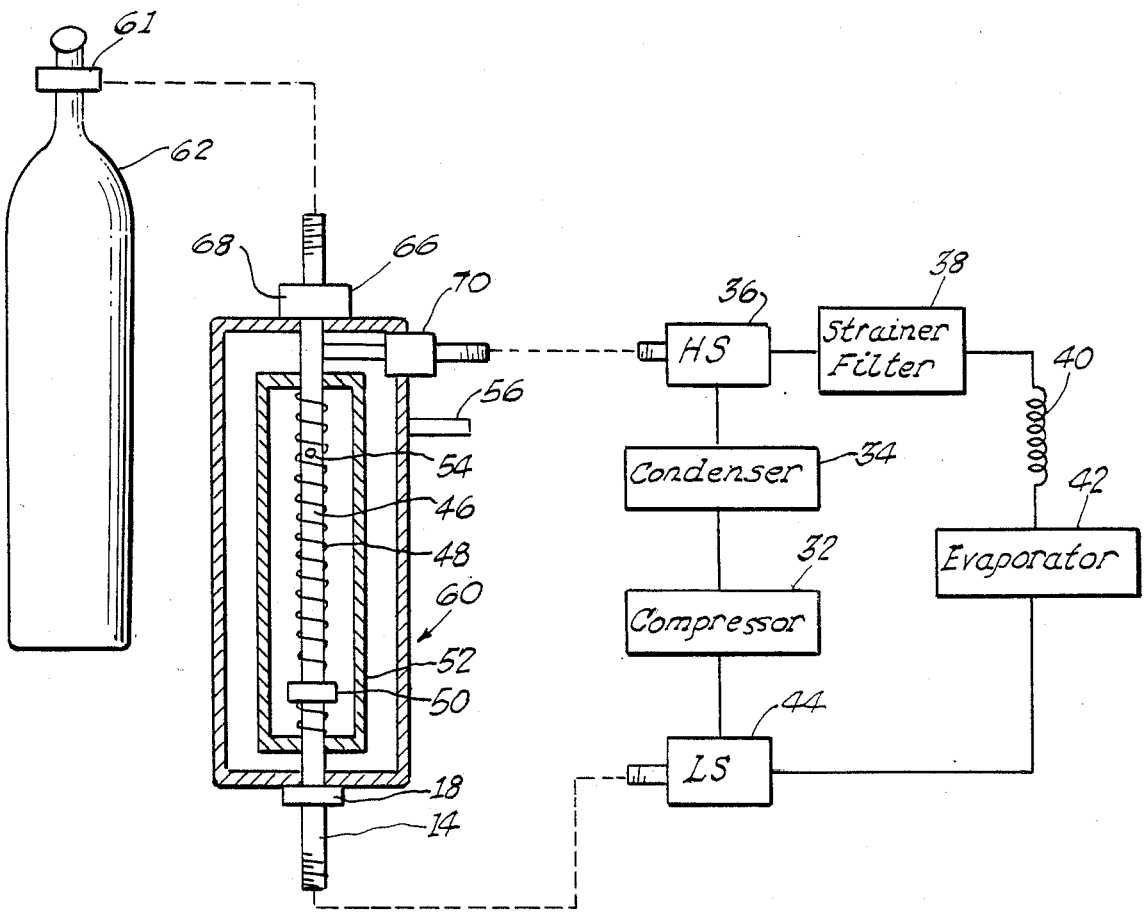
FIG. 4 shows a second embodiment of the gas heating and insertion device.

Referring now to FIG. 4, an alternate embodiment of the invention is shown which is particularly useful with larger systems to increase the temperature of the nitrogen gas within the refrigeration unit. In FIG. 4, like numerical designations are given for like component parts described previously with respect to FIGS. 1 through 3. The major difference in the gas heating and insertion device 60 shown in FIG. 4 is that the nitrogen gas is regulated at the tank 62 by the regulator valve 64. The regulated gas is provided to inlet pipe 12 and then through a manual valve 66 which replaces regulator 16 of FIGS. 1 through 3. Manual valve 66 may be opened, partially opened, or shut by turning a handle 68 to the appropriate position.

The only other change between devices 10 and 60 is that a regulated clock valve 70 is connected into pipe 46. Check valve 60 is directed to only allow gas to flow into pipe 54 and may be coupled to the high side valve 36 of the refrigeration unit. With this arrangement, gas within the refrigeration unit may be fed back into device 60 and again heated. Thus, the gas may flow through pipe 46 much faster in as much as it need not be heated to the maximum temperature prior to entering the refrigeration unit. Once that gas passes through compressor 32 and condenser 34, it had been heated due to the compression. Then when a part of the gas is returned to unit 60 through check valve 70, it may be heated more quickly to the desired temperature. The size of check valve 70 should be selected with respect to the size of metering tubes 40 so that approximately one-half of the gas into high side valve 36 goes through check valve 70.

What I claim is:

1. Apparatus for removing moisture from a refrigeration unit, said refrigeration unit including a compressor, a condenser and an evaporator coupled in a loop, said refrigeration unit further including a low pressure side valve between said compressor and said evaporator and a high pressure side valve between said condenser and evaporator, said apparatus comprising:

output coupling means adapted for being coupled to said low pressure side valve when opened;

input coupling means adapted for being coupled to a source of a dry gas;

gas transfer and heating means, positioned between said output coupling means and input coupling means, for transferring and heating dry gas applied through said input coupling means to said output coupling means;

sensing means for sensing the temperature and pressure of said dry gas transferred to said output coupling means; and means for manifesting the sensed temperature and pressure to indicate when to close said low pressure side valve.

2. The invention according to claim 1 wherein said input coupling means includes pressure regulating means.

3. The invention according to claim 1 wherein said gas transfer and heating means includes thermostat means for controlling the heating of the gas transferred therethrough.

4. The invention according to claim 3 wherein said thermostat means controls said gas transfer and heating means so that the gas transferred to through said output coupling means is between 175 degrees F. and 220 degrees F.

5. The invention according to claim 3 wherein said input coupling means includes pressure regulating means.

6. The invention according to claim 5 wherein said regulating means is set between 35 and 65 pounds per square inch pressure.

7. The invention according to claim 6 wherein said thermostat means controls said gas transfer and heating means so that the gas transferred to through said output coupling means is between 175 degrees F. and 220 degrees F.

8. The invention according to claim 7 wherein said gas transfer and heating means includes a cylinder in fluid communication with said input coupling means with said output coupling means and strip heating means attached to said cylinder means.

9. The invention according to claim 8 wherein said cylinder and strip heating means are enclosed in the heat insulating means.

10. The invention according to claim 1 wherein said gas transfer and heating means includes a cylinder in fluid communication with said input coupling means and said output coupling means and strip heating means attached to said cylinder means.

11. The invention according to claim 10 wherein said cylinder and strip heating means are enclosed in heat insulating means.

12. The invention according to claim 1 wherein means for indicating said sensed pressure and temperature include gauge means.

13. The invention according to claim 1 wherein said input coupling means further includes a one-way valve adapted to being coupled to said high pressure side valve, when open.

14. The invention according to claim 13 wherein said means for manifesting further indicate when to close said high pressure side valve.

15. The invention according to claim 14 wherein said one-way valve is a regulated check valve.

16. The invention according to claim 13 wherein said one-way valve is a regulated check valve.

17. The invention according to claim 13 wherein said input coupling means includes pressure regulating means.

18. The invention according to claim 13 wherein said gas transfer and heating means includes thermostat means for controlling the heating of the gas transferred therethrough.

19. A method of removing moisture from a refrigeration unit, said refrigeration unit including a compressor, condenser, and evaporator connected in a loop, said unit further having a low pressure side valve positioned between said evaporator and said compressor and a high pressure side valve positioned between said condenser and said evaporator, said method comprising he steps of:

heating a dry gas;

providing the heated dry gas through said low pressure side valve;

operating said refrigeration unit;

opening said high pressure side valve for exhausting said gas; and recharging said unit by providing refrigerant through said low pressure side valve.

20. The method according to claim 14 wherein said dry gas is heated to a temperature of between 175 degrees F. and 220 degrees F.

21. The method according to claim 19 wherein said heated dry gas is provided through said low pressure side valve until the pressure in said unit is between 35 pounds per square inch and 65 pounds per square inch.

22. The method according to claim 21 wherein said dry gas is heated to a temperature of between 175 degrees F. and 220 degrees F.

23. The method according to claim 19 wherein said refrigeration unit is operated by operating said compressor.

24. The method according to claim 19 wherein said method further includes the step of closing said high pressure side valve after said refrigerator begins escaping from said high pressure side valve.

25. The method according to claim 24 wherein said dry gas is heated to a temperature of between 175 degrees F. and 220 degrees F.

26. The method according to claim 25 wherein said heated dry gas is provided through said low pressure side valve until the pressure in said unit is between 35 pounds per square inch and 65 pounds per square inch.

27. The method according to claim 19 further including the step of feeding back some of said gas from the high pressure side valve while operating said unit to be again heated and provided to said low pressure side valve.

* * * * *